US005871374A

United States Patent [19]

Maney

[11] Patent Number: 5,871,374

[45] Date of Patent: Feb. 16, 1999

[54] CONNECTOR HOUSING

[76] Inventor: Boytcho Maney, 2783 Phillips, Berkley, Mich. 48072

[21] Appl. No.: 795,037

[22] Filed: Feb. 5, 1997

Related U.S. Application Data

[60] Provisional application No. 60/011,354, Feb. 8, 1996.

[51] Int. Cl.[6] ..... H01R 13/40

[52] U.S. Cl. ..... 439/596; 439/696; 439/467

[58] Field of Search ..... 439/595, 596, 439/603, 695, 597

[56] References Cited

U.S. PATENT DOCUMENTS

| | | | |
|---|---|---|---|
| 4,017,141 | 4/1977 | Bury et al. | 439/596 |
| 4,040,703 | 8/1977 | Shaffer et al. | 439/402 |
| 4,418,978 | 12/1983 | Shamir | 439/596 |
| 4,607,903 | 8/1986 | Hoshino et al. | 439/370 |
| 4,660,914 | 4/1987 | Nakamura | 439/596 |
| 4,759,723 | 7/1988 | Siemon | 439/409 |
| 4,767,361 | 8/1988 | Hoshino et al. | 439/596 |
| 4,789,348 | 12/1988 | Hampton | 439/142 |
| 4,900,277 | 2/1990 | Inaba et al. | 439/752 |
| 5,122,081 | 6/1992 | Bogiel et al. | 439/596 |
| 5,295,857 | 3/1994 | Toly | 439/596 |

*Primary Examiner*—Hien Vu

*Attorney, Agent, or Firm*—Gifford, Krass, Groh, Sprinkle, Patmore, Anderson & Citkowski, P.C.

[57] ABSTRACT

A connector housing for an electrical terminal includes a base member configured to engage a top member having two discrete segments. One of the segments engages the base member so as to retain an electrical terminal therebetween in a preconnection mode which exposes a portion of the terminal so as to permit electrical connection to be made thereto. A second segment of the top member engages the base member so as to enclose the electrical connection which was made to the terminal so as to provide a closed, assembled electrical connector.

5 Claims, 6 Drawing Sheets

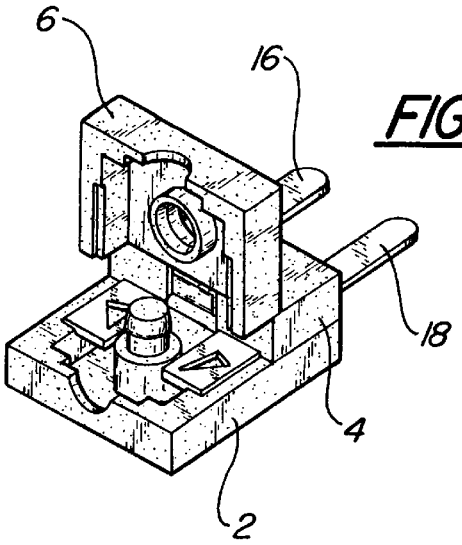
FIG-4
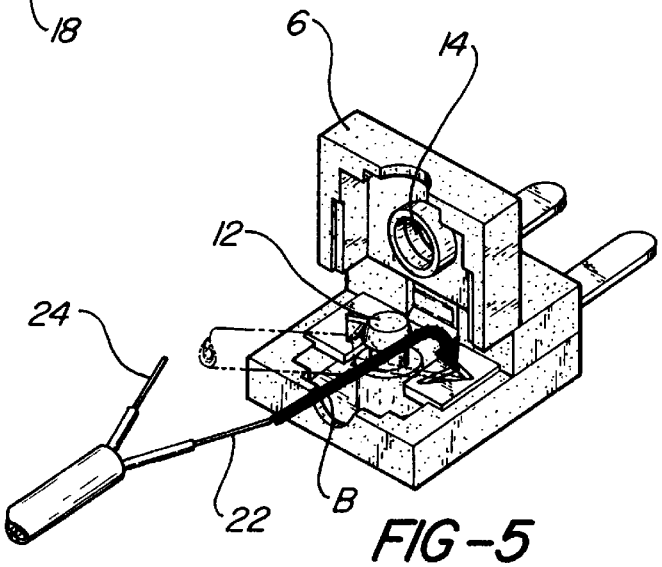
FIG-5
FIG-6
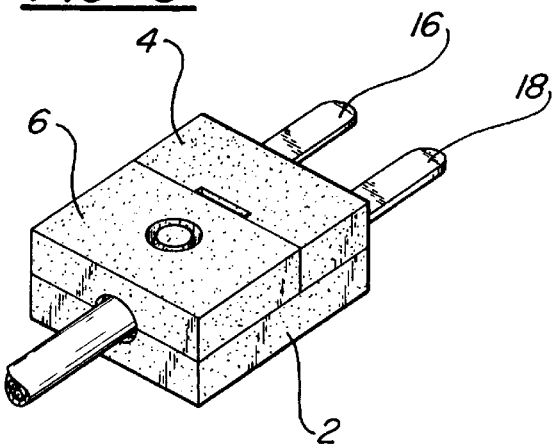
FIG-7
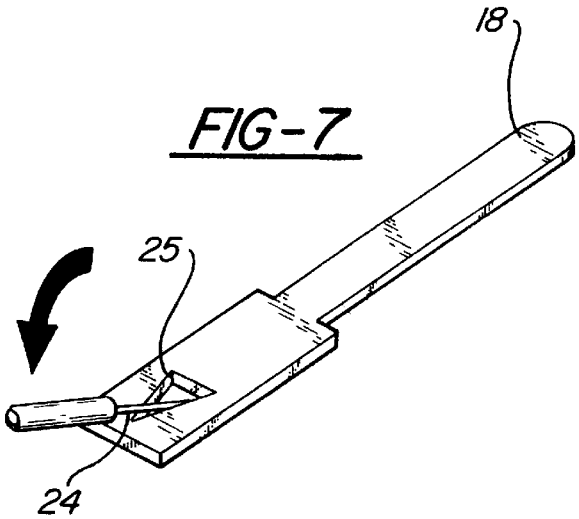

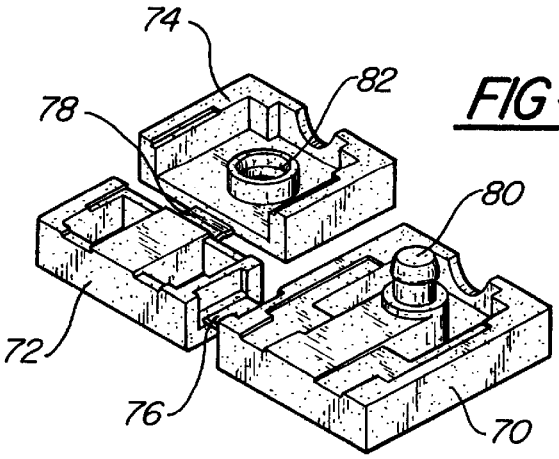
FIG-13A
FIG-13B
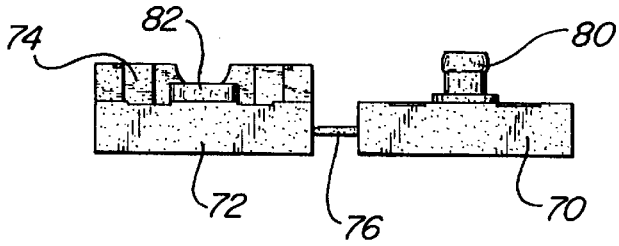
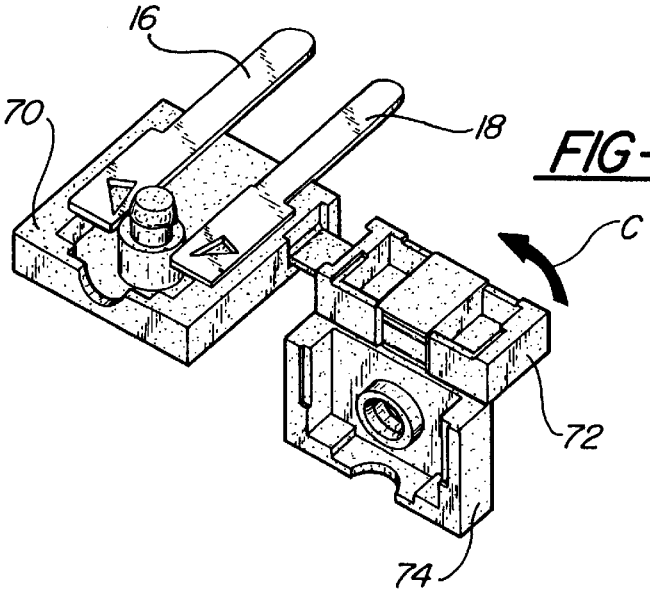
FIG-14
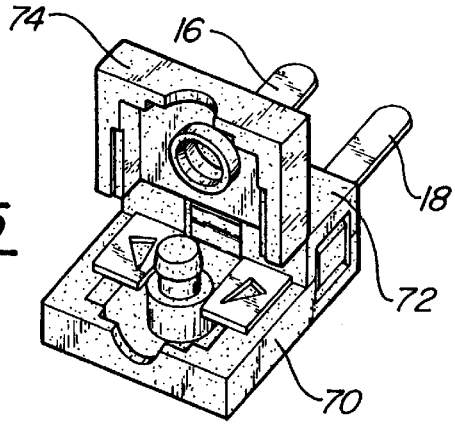
FIG-15

CONNECTOR HOUSING

RELATED APPLICATION

This application claims the benefit of U. S. Provisional Application No. 60/011,354 Filed Feb. 8, 1996.

FIELD OF THE INVENTION

This invention relates generally to electrical connectors. More specifically, the invention relates to a connector housing which supports at least one terminal member in engagement with an electrically conductive wire. Most specifically, the invention relates to a connector housing which provides both a preconnect configuration in which the terminal member is securely supported so as to permit electrical connection to be made to it, and a fully assembled configuration in which the electrical connection to the terminal member is enclosed.

BACKGROUND OF THE INVENTION

One type of electrical connector comprises a housing, usually fabricated from a polymeric material or other such insulator, which is structured to retain one or more electrically conductive terminal members as well as a wire or other such electrical conductor which is connected to the terminal. Such connectors are employed as plugs, sockets or the like and have very widespread use. In the course of assembling a connector of this type electrical leads or wires are connected to the terminals, either before the terminals are inserted into the housing or after, and the housing then closed about the conductor and terminal to retain the connection therein. Assembly of connectors of this type can be very labor intensive and/or may require the use of complex fixturing hardware or the like. The problems associated with the assembly of such connectors are exacerbated when the connectors are small in size.

There is thus a need for a connector housing which minimizes the labor and/or hardware associated with the assembly of connectors therefrom. Also, the housing should include a minimal number of parts, and in an ideal situation the housing is unitary.

A number of connector housings are known in the prior art, and two versions are shown in U.S. Pat. Nos. 4,017,141 and 4,789,348, both of which disclose unitary connector housings. However, nowhere in the prior art is there shown any connector housing having the features and advantages of the present invention. As will be described hereinbelow, the present invention is directed to a connector housing which is configured to securely retain one or more electrical terminals therein, in a preconnection mode wherein the terminals are rigidly supported, but accessible for affixation of electrical leads thereto. After connection is established, the housing is closed into an assembled mode wherein the connections are enclosed and stably retained. The connector housings of the present invention are preferably one or two part devices and may be manufactured in a variety of configurations to accommodate male as well as female terminals. These and other advantages of the invention will be readily apparent from the drawings, discussion and description which follow.

BRIEF DESCRIPTION OF THE INVENTION

There is disclosed herein a connector housing for retaining one or more electrical terminal members. The housing includes a base member which is configured to receive an electrical terminal therein. The housing also includes a top member which has a first segment and a second segment which are hingedly interconnected. The first segment is configured to engage the base member and to retain an electrical terminal between itself and the base member so that a connector portion of the retained terminal is exposed and accessible for establishment of an electrical connection thereto. Tile second segment is also engageable with the base member independently of the first segment, and is operable, when engaged with the base member, to enclose the connector portion of the retained terminal. The housing of the present invention provides a preconnect configuration in which the first segment and base member cooperate to retain the terminal and to permit an electrical connection to be made to it. The housing also provides an assembled configuration in which the electrical connection to the terminal is enclosed between the second segment and the base member. In this manner, the housing is self-fixturing, and its use greatly simplifies the assembly of electrical connectors.

In one embodiment of the invention the first and second segment of the top member are formed from an organic polymer, and are interconnected by a living hinge. In other embodiments, the first segment of the top member is hingedly connected to the base member, and such connection may also be established by a living hinge. In yet other embodiments, the connector includes one or more socket and post couplers for retaining the base member and the top member in engagement.

BRIEF DESCRIPTION OF THE DRAWINGS

FIG. 4 is a perspective view of the housing shown in FIG. 3 as disposed in the preconnection mode;

FIG. 5 is a perspective view of the connector housing of FIG. 4 showing the connection of an electrical lead to a terminal therein;

FIG. 6 is a perspective view of a fully assembled connector in accord with the present invention;

FIG. 7 is an enlarged view of terminal member showing the connection of a lead wire thereto;

FIGS. 13A and 13B depict another embodiment of housing structured in accord with the present invention;

FIG. 14 shows the connector of FIG. 13 having terminal members placed therein; and FIG. 15 shows the assembly of FIG. 14 in the preconnection mode.

DETAILED DESCRIPTION OF THE INVENTION

The connector of the present invention is a unitary device which constitutes a housing which supports one or more electrical terminals and associated electrically conductive lead wires. The housing of the present invention is configured to provide a preconnect configuration wherein a first portion of the housing is closable so as to retain a terminal member therewithin in a manner which will permit access to a portion of the terminal for the establishment of electrical connection. After appropriate connection is made, the housing is fully closed to an assembled configuration so as to retain and seat the electrical terminal and the conductive wire. The housing provides a screwless, crimpless member which is self-fixturing and is readily adapted to machine assembly techniques as well as manual assembly techniques.

The housing of the present invention may be readily manufactured, preferably from somewhat resilient, synthetic polymeric materials, by a number of commercially viable molding processes. The housing of the present invention may be manufactured in a variety of configurations, and the attached drawings illustrate several configurations in accord with the invention, it being understood that other configurations are within the scope of the invention, and other embodiments will be readily apparent to one of skill in the art in view of the disclosure herein.

Figure 1A:
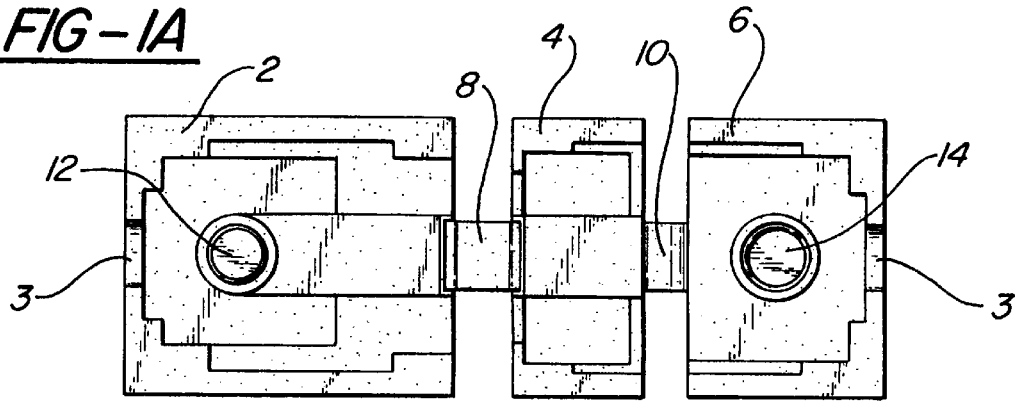
FIG. 1A is a top plan view of one embodiment of connector housing structured in accord with the present invention.
Figure 1B:
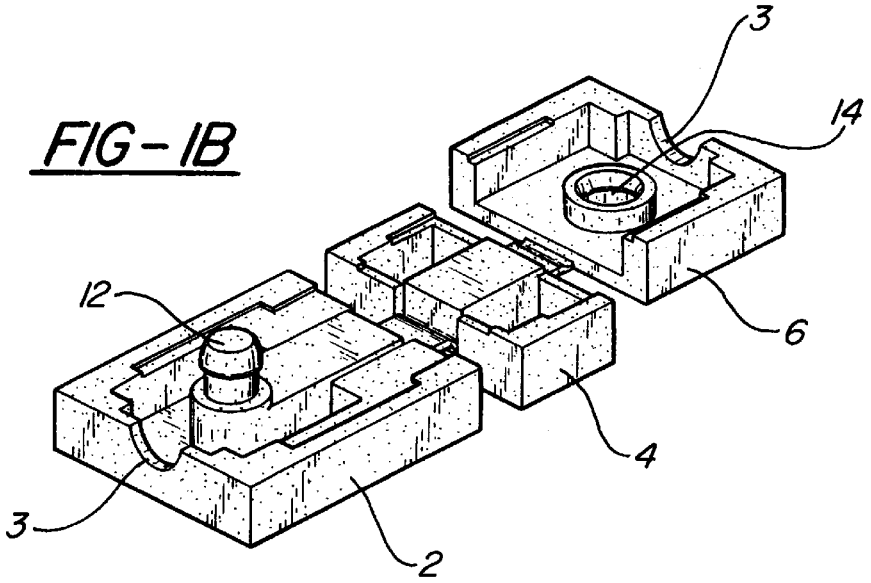
FIG. 1B is a perspective view of the housing of FIG. 1A.
Figure 1C:
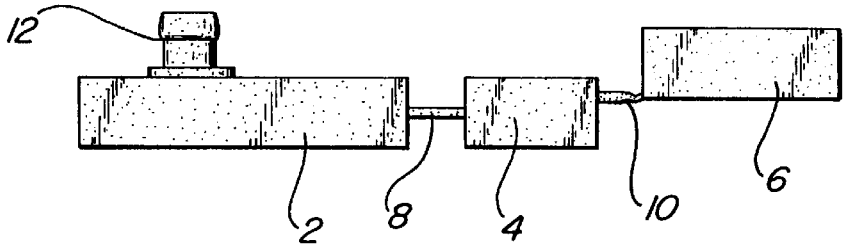
FIG. 1C is a side elevational view of the housing of FIG. 1A.
Figure 2A:
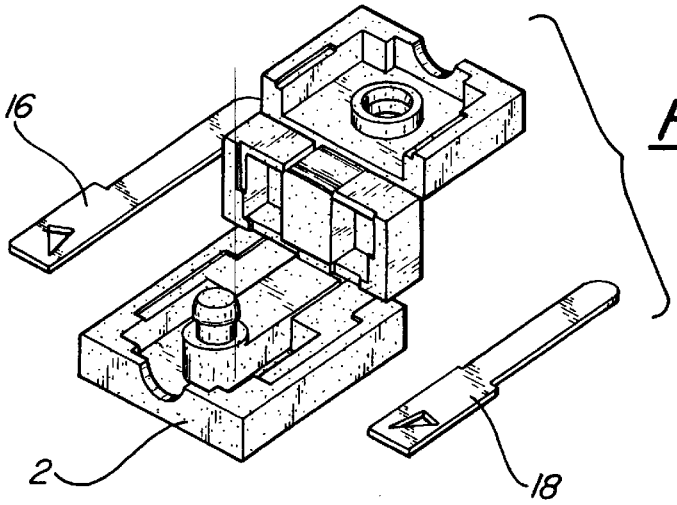
FIG. 2A is a perspective view of the housing of FIG. 1A showing the insertion of terminal members thereinto.
Figure 2B:
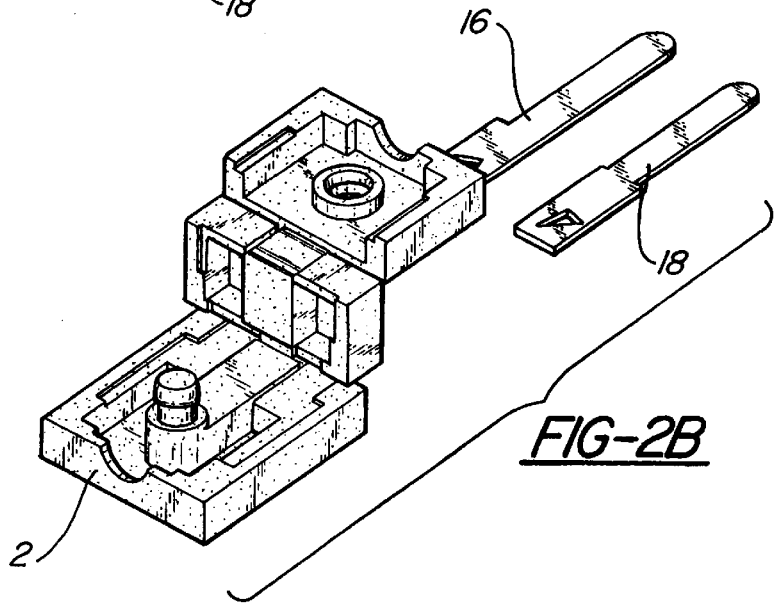
FIG. 2B is a perspective view of the connector housing of FIG. 1A showing an alternative mode of insertion of terminal members thereinto.

Referring now to FIGS. 1A–1C, there is shown one embodiment of a connector housing illustrating the general principles of the present invention. FIG. 1A is a top view of the connector housing, and it will be noted that it includes three sections, 2, 4 and 6 separated by living hinges 8, 10. Section 2 comprises a base member of the housing, while the other sections, 4 and 6, are segments of a top member of the housing. Section 2 and section 6 each include a notch, 3, which provides clearance for an electrical wire to pass into the housing. This connector housing is preferably manufactured from a resilient polymer such as polypropylene, polyethylene or the like. FIG. 1B is a perspective view of the same housing, and it will be noted that it is configured so that the third section, 6, lies in a plane elevated with regard to the plane of the first 2 and second 4 sections. It will also be noted that the connector includes a snap arrangement having a snap post 12 on the first section 2 and a corresponding socket 14 on the third section 6. FIG. 1C is a side elevational view of the connector.

Figure 3:
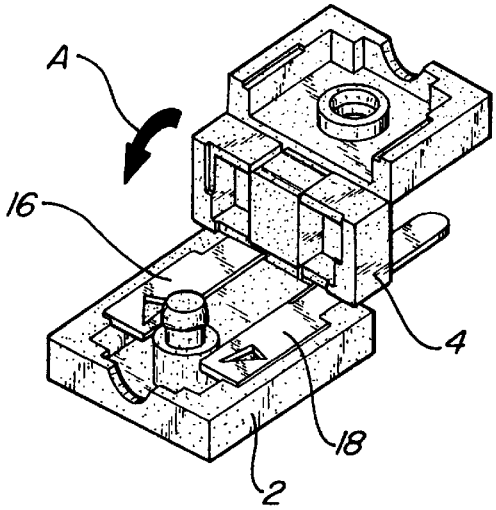
FIG. 3 is a perspective view of the housing of FIG. 1A with the terminal members inserted thereinto.

FIGS. 2–8 illustrate the operation of the connector housing. As shown in FIG. 2A, a pair of terminal blades 16, 18 are provided. These terminal blades are preferably fabricated from brass or a like conductor, and are particularly configured to fit into the connector of the present invention, and toward that end include a widened tab portion, it being understood that other configurations of connector and terminals may be similarly employed. As shown in FIG. 2A, the connectors 16, 18 are laterally slid into the first section 2 of the housing into a seated position as shown in FIG. 3. Insertion of the terminals 16, 18 may be accomplished manually or by machine. Alternatively, the terminal members 16, 18 may be longitudinally inserted into the connector as shown in FIG. 2B. In either event, the final configuration is the same, and is shown at FIG. 3.

In the next stage of the assembly, the second section 4 of the connector has been rotated downward and into alignment with the first section 2, as indicated by arrow A in FIG. 3, so as to retain the terminal members 16, 18 in the connector. As specifically shown in FIG. 4, the second section 4 and the first section 2 of the connector are engaged, and the terminals 16 and 18 are fixably retained therein in a preconnect configuration in which each of the terminals has a free end exposed at the surface of the first section 2 of the connector so is to permit establishment of electrical connection thereto. Although not illustrated, the first 2 and second 4 sections of the connector may include a snap or other such detent means to maintain them in engagement when the connector is in the preconnect configuration.

Referring now to FIG. 5 there is shown the attachment of electrical leads to the connector. FIG. 5 shows the housing in the configuration illustrated in FIG. 4, further including a pair of electrically conductive lead wires 22, 24 disposed so as to be connected thereto. As indicated in FIG. 5, by arrow B, each of the wires 22, 24 is inserted into the V-shaped opening in the corresponding terminal 16, 18. The wire 24 engages the sharp point in the V-shaped opening and establishes electrical communication therewith. After the wires are attached, the third section, 6, of the housing is rotated into engagement with the first section 2 so as to join the snap post 12 and socket 14 to provide a closed, rigid, fixed connector as illustrated in FIG. 6.

Figure 8:
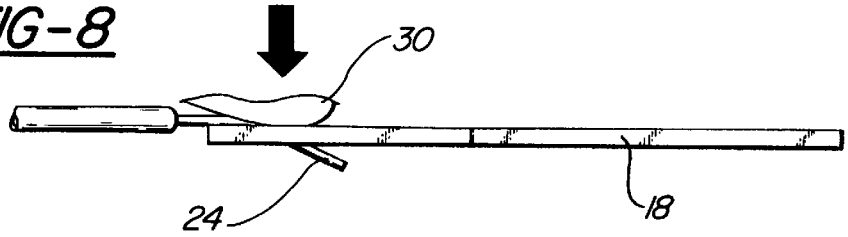
FIG. 8 is an enlarged view of terminal member having an electrical lead affixed thereto.
Figure 9A:
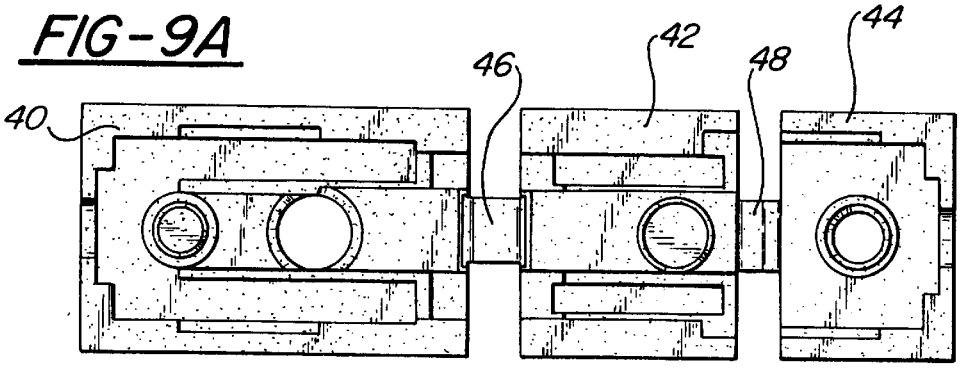
FIGS. 9A–9C show an alternative embodiment of connector housing structured in accord with the present invention.
Figure 9B:
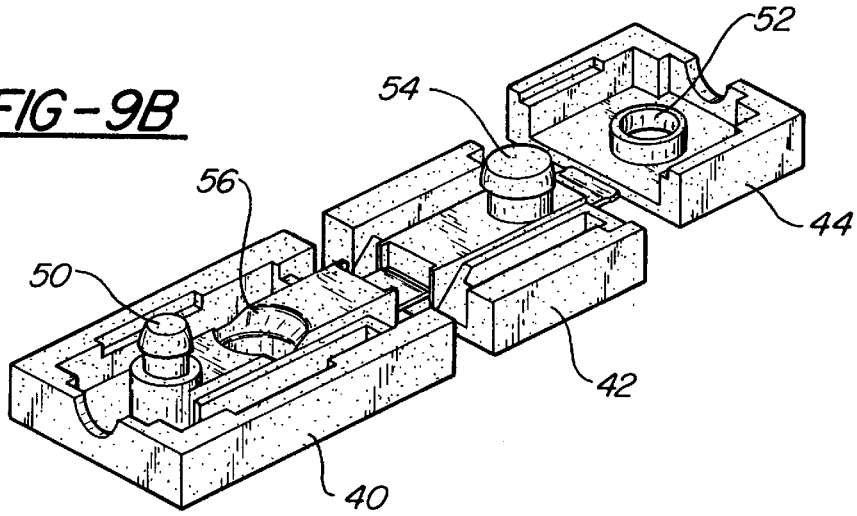
Figure 9C:
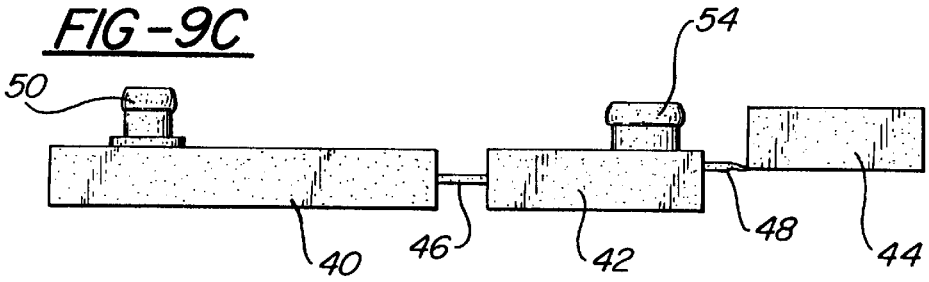

FIGS. 7 and 8 illustrate the connection of the wire 24 to a terminal 18. As specifically shown in FIG. 7, the wire 24 is inserted into the V-shaped opening 25 in the terminal member 18, and is gripped by the vertex of the V. As further illustrated in FIG. 8, the connector housing may be configured to include a projecting portion, shown in fragmentary view herein as portion 30, positioned so as to urge the wire 24 into engagement with the terminal 18 when the housing is snapped together. It is to be understood Mat the wires may be otherwise attached to the terminal, as for example by the use of screws or other such fasteners, by solder, or by techniques such as welding or wire wrapping.

FIGS. 9–12 illustrate another embodiment of the present invention. This embodiment also includes three segments 40, 42, 44 joined by living hinges 46, 48. The first segment 40 defines the base member of the housing, and the other two segments 42 and 44 define the top member of the housing. This embodiment includes two separate snap assemblies. The first comprises a first snap post 50 disposed on the first segment 40 and a corresponding snap socket 52 disposed on the third segment 44. A second snap assembly comprises a second snap post 54 disposed on the second segment 42 and a corresponding second snap socket 56 on the first segment 40. The inclusion of the second snap assembly 54, 56 serves to further maintain the integrity of the connector when it is in the preconnect configuration.

Figure 10A:
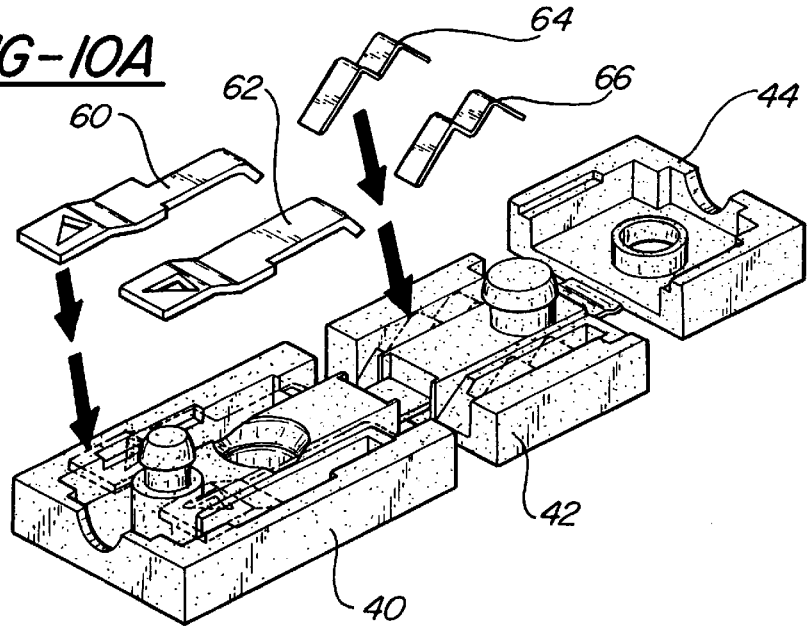
FIGS. 10A and 10B show the insertion of terminal members into the connector housing of FIG. 9.
Figure 10B:
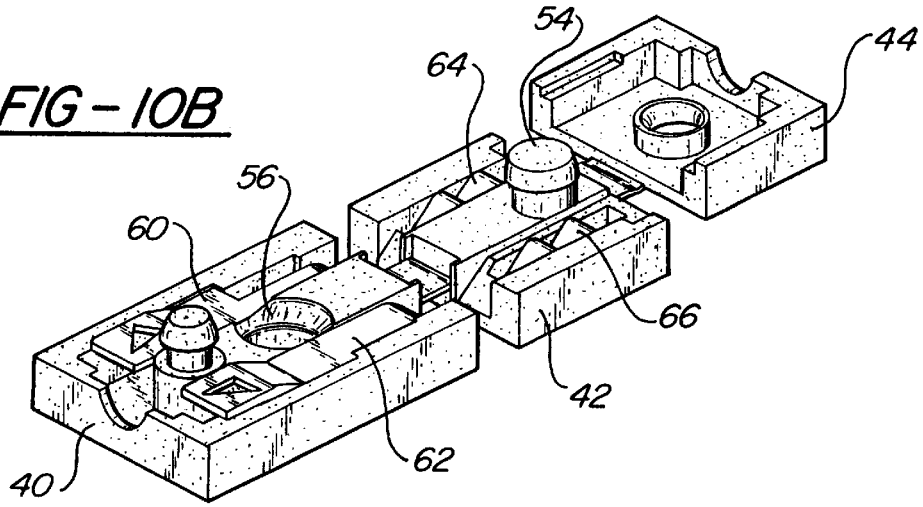
Figure 11:
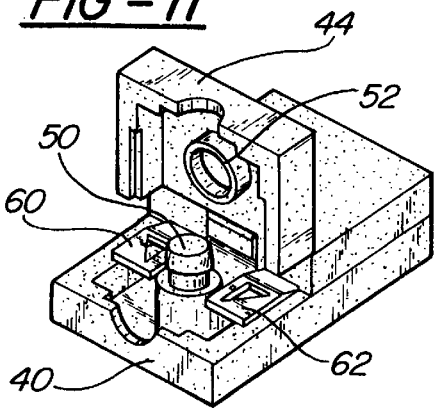
FIG. 11 depicts the connector housing of FIG. 9 as having terminals retained therein in a preconnection mode.
Figure 12:
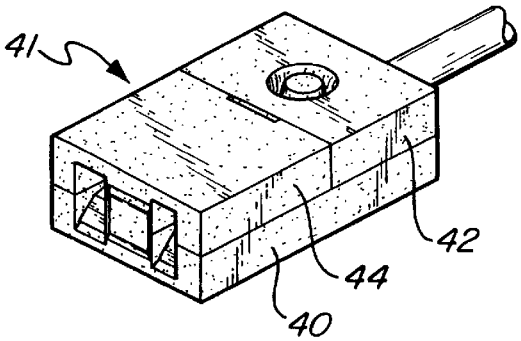
FIG. 12 is a perspective view of a fully assembled connector of FIGS. 9–11.

FIGS. 10–12 illustrate the assembly of the connector described hereinabove. As shown in FIG. 10A, a set of terminals 60, 62 are placed in the first segment 40, and a set of spring members 64, 66 are placed in the second segment 42 to provide the configuration illustrated in FIG. 10B. The terminals 60, 62 are shown as socket-type terminals which receive blade terminals of the type shown at 16, 18 in previous figures The second segment 42 is rotated into engagement with the first segment 40, and the second snap assembly 54, 56 is engaged to provide the preconnection configuration illustrated in FIG. 11. The presence of the second snap assembly assures positive retention of the first 40 and second 42 segments against the bias of the spring elements 64, 66. The further assembly of the connector includes connection of wire leads to the terminals 60, 62. Finally, the third segment 44 is engaged to the base segment 40 to provide a completed connector 41, as shown in FIG. 12. As will be seen from FIG. 12, the housing includes access openings 43, which communicate with the terminals. It is also to be noted that in the embodiment of FIGS. 13–15, the terminal members inserted therein are female terminals adapted to receive a blade contact; but, the embodiment of the connector housing shown in these figures could likewise be used with blade type male terminals.

Another embodiment of the connector housing is shown in FIGS. 13–15. The housing shown therein is again comprised of three segments. As specifically shown in FIGS. 13A and 13B, the connector housing includes a first segment 70, a second segment 72 and a third segment 74 joined by living hinges 76 and 78. The first segment 70 includes a snap post 80 and the third segment 74 includes a snap socket 82, it being understood that the position of these elements can be reversed as in previous embodiments. FIG. 14 illustrates the placement of terminal members 16, 18 in the first segment 70 of the housing. As shown in FIG. 14, by arrow c, the second segment 72 is folded onto the first segment 70 to provide the preconnect configuration illustrated in FIG. 15. Electrical connection to the terminal members 16, 18 is established as in the previous embodiments, and the third segment 74 is then snapped onto the first segment 70 to provide the final, assembled configuration.

Still other modifications of the present invention may be implemented. For example, all of the foregoing embodiments show the connector housing as being a unitary body having sections joined by living hinges. In some instances, it may be advantageous to manufacture the connector housing from discrete segments, not joined by hinges. Clearly, the structure and operation of the connector would be analogous. In most instances, it is desirable to at least join the segments forming the top member of the connector as a single, hinged unit. Also, in some instances particular configurations may dictate that yet other segments be included in the connector housing, as for example to provide strain relief for a conductor passing through the housing, or to provide a retainer for a sealing grommet or the like. Also, while snap type connectors are shown as being used to hold the segments of the housing together, other arrangements are contemplated within the scope of the present invention. For example, an interference fit between the segments may suffice to hold the housing together in some instances. In other instances, a discrete screw, clip, or other such mechanical connector may also be advantageously included in combination with the present invention. It should also be kept in mind that while the foregoing illustrations show a connector having two terminal members therein, the housing of the present invention may be employed in connection with the fabrication of connectors having a larger or smaller number of terminals.

In view of the foregoing, it will be understood that the drawings, discussion and description presented herein are illustrative of particular embodiments of the invention, but are not meant to be limitations upon the practice thereof. It is the following claims, including all equivalents, which define the scope of the invention.

I claim:

1. A connector housing for retaining an electrical terminal comprising:

a base member configured to receive an electrical terminal therein, said base member having a top side and a bottom side;

a top member having a first segment and a second segment hingedly connected to said first segment, said first segment hingedly corrected to said base member by a hinge so as to retain an electrical terminal therebetween so that a connector portion of the retained terminal is exposed and accessible for establishment of an electrical connection thereto, said second segment being engageable with said base member by connector means, independently of said first segment, and operating when so engaged so as to enclose the connector portion of the retained terminal therebetween; whereby said housing provides both a preload configuration, in which said first segment and base member cooperate to retain the terminal and to permit an electrical connection to be made thereto, and an assembled configuration in which the terminal is retained by, and the electrical connection thereto is enclosed between, the second segment and the base member, wherein said first and said second segments of said top member cover said top side of said base member.

2. A connector housing as in claim 1, said connector means comprising a socket and post for retaining the base member and top member in engagement, wherein the socket is defined upon one of said base member and top member, and the post is defined upon the other of said base member top member.

3. A connector housing as in claim 1, further including two socket and post couplers for retaining said base member and top member in engagement, each coupler including a snap portion defined on one of said top member and said base member, and a post portion defined on the other of said top member and said base member.

4. A connector housing as in claim 1, wherein said base member and top are configured to retain an electrical terminal so that a portion of said terminal projects from said housing when said first and second segments of said top member are engaged with said base member.

5. A connector housing as in claim 1, wherein said base member and top member are configured so as to retain a female electrical terminal between, and to define an access opening, in communication with said retained female terminal, when said first and second segments are engaged with said base member.

* * * * *

UNITED STATES PATENT AND TRADEMARK OFFICE

CERTIFICATE OF CORRECTION

PATENT NO. : 5,871,374

DATED : February 16, 1999

INVENTOR(S) : Boytcho Manev

It is certified that error appears in the above-identified patent and that said Letters Patent is hereby corrected as shown below:

Column 2, line 6, please replace "Tile" with --THE--.
Column 4, line 60, please insert --.-- at the end of the sentence.

Title Page, item [19] under the heading "United States Patent," please delete the inventors name "Maney" and insert --Manev--.

Title Page, item [76] entitled "Inventor", please delete the inventor's name "Maney", and insert -- Manev--.

Signed and Sealed this

Twenty-seventh Day of July, 1999

*Attest:*

Q. TODD DICKINSON

*Attesting Officer*

*Acting Commissioner of Patents and Trademarks*